United States Patent [19]

Real

[11] 4,062,300

[45] Dec. 13, 1977

[54] MULTIPURPOSE PALLET SYSTEM

[75] Inventor: Eric John Real, Cinderford, England

[73] Assignee: Rank Xerox Ltd., London, England

[21] Appl. No.: 684,518

[22] Filed: May 10, 1976

[30] Foreign Application Priority Data

Oct. 24, 1975 United Kingdom ..... 43920/75

[51] Int. Cl.[2] ..... B65D 19/26

[52] U.S. Cl. ..... 108/53.5; 108/55.1; 108/55.3; 108/56.1

[58] Field of Search ..... 108/51.5–57.1, 108/901, 902; 206/386; 214/10.5 R; 85/5 LP, 8.1, 61; 403/2; 285/2–4; 188/1 C

[56] References Cited

U.S. PATENT DOCUMENTS

| | | | |
|---|---|---|---|
| 1,651,265 | 11/1927 | Freden | 85/8.1 X |
| 2,450,848 | 10/1948 | Wisberger | 108/56.1 |
| 2,579,685 | 12/1951 | Loose | 108/53.5 |
| 2,699,912 | 1/1955 | Cushman | 108/53.3 X |
| 2,775,360 | 12/1956 | Phillips | 108/53.3 X |
| 2,947,565 | 8/1960 | Wood | 108/55.1 X |
| 3,199,469 | 8/1965 | Sullivan | 108/53.3 |
| 3,339,215 | 9/1967 | Flood | 85/61 X |
| 3,393,647 | 7/1968 | Howell | 108/53.3 X |
| 3,667,403 | 6/1972 | Angelbeck, Jr. | 108/51.1 |
| 3,685,461 | 8/1972 | Belcher | 108/901 X |
| 3,702,100 | 11/1972 | Wharton | 108/53.3 |
| 3,717,224 | 2/1973 | Leach et al. | 188/1 C |
| 3,738,390 | 6/1973 | Luckenbill | 403/2 X |
| 3,921,540 | 11/1975 | Melnick et al. | 108/55.1 |
| 3,961,707 | 6/1976 | Lehr et al. | 206/386 X |

FOREIGN PATENT DOCUMENTS

| | | | |
|---|---|---|---|
| 1,447,363 | 6/1966 | France | 108/53.1 |

*Primary Examiner*—Roy D. Frazier
*Assistant Examiner*—William E. Lyddane
*Attorney, Agent, or Firm*—Max J. Kenemore; Eugene O. Palazzo; James J. Ralabate

[57] ABSTRACT

A multipurpose pallet system is provided which includes a deck means attachable either to a base member or a plurality of base members by shear pin and spring connections providing a yieldable break-away connection. Openings in the deck means receive pallet posts which are useful for supporting side members and for stacking the pallets.

10 Claims, 11 Drawing Figures

FIG. 1.
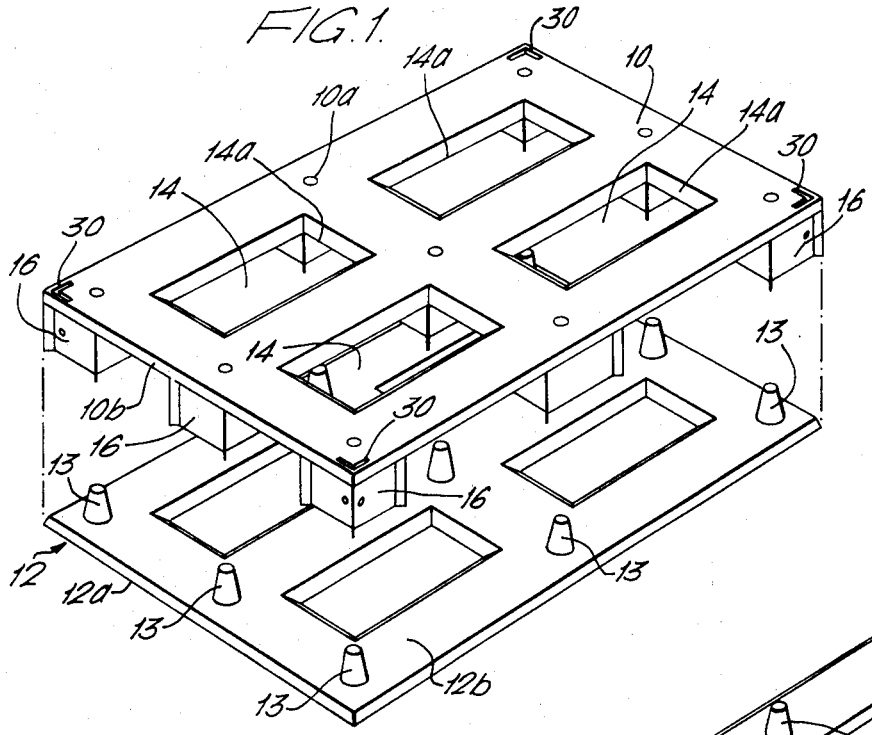
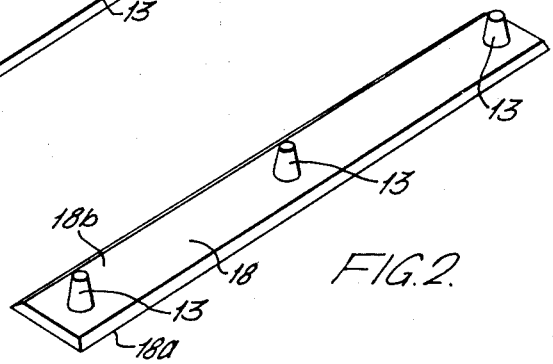
FIG. 2.
FIG. 3.
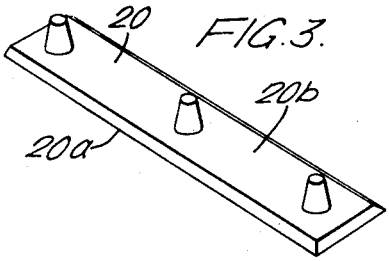
FIG. 4.
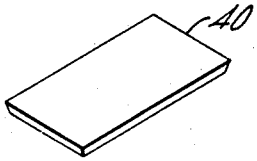
FIG. 7.
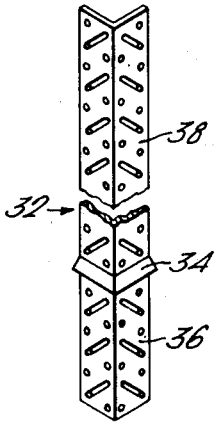
FIG. 5.
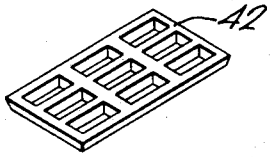
FIG. 6.
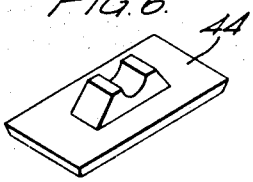

MULTIPURPOSE PALLET SYSTEM

BACKGROUND OF THE INVENTION

This invention relates generally to materials handling and particularly concerns a multipurpose pallet system.

Efficient handling and shipment of items such as pieces of machinery is conveniently effected by the use of pallets whereby material handling equipment such as fork lifts easily interact with the pallets to transfer the items from one place to another. Although pallets are well known in the art, the present multiplicity of designs is indicative of an important shortcoming, namely that a proportionately great number of itmes handled on pallets require a special specific pallet design to be safely and effeciently handled. This multiplicity of designs is inefficient and wasteful or resources. Thus, for example, where a machine say is to be shipped on a special pallet from a point of manufacture to a destination it usually happens that the pallet is either thrown away at great waste or shipped back to the point of manufacture for reuse at great expense. In the past efforts at reaching a solution to this problem appear to have been concentrated on finding a material which was inexpensive and could be easily disposed of. While wood initially met this requirement, its cost in terms of material and the labor of constructing pallets from it have made it prohibitive. Plastic materials provide an excellent alternative as they are generally light, durable and readily mouldable to specific configurations. However, here too material costs have risen and design flexibility is economically limited as the cost of producing dies or moulds for each separate design is relatively speaking, extremely high. Thus, plastic molds are somewhat undesirable where the pallet design is varied periodically. Moreover, where a multiplicity of special designs is required, storage and inventory of the pallets is a burden. Although there are indications in the prior art as represented by U.K. Pat. Nos. 1,304,760; 1,310,898; 1,335,445 and 1,382,737; that pallets adaptable to a range of uses have been considered, it is clear upon review that these prior art pallets do not provide a complete solution and leave much room for improvement.

SUMMARY OF THE INVENTION

It is an object of the present invention to provide a pallet system which overcomes the disadvantages of the prior art.

It is another object of the present invention to provide a pallet system comprised of a plurality of interchangeable parts which are inexpensively produced and readily stored.

It is a further object of this invention to provide a pallet system comprised of a plurality of interchangeable parts which are combineable in a variety of ways to accommodate a wide range of items.

These and other objects are provided by a multipurpose pallet which comprises, generally, a deck means having first and second outer dimensions with at least one opening in the deck adapted to receive an insert member. Also included is a base means attached to the deck. The base comprises either a single member having the same general dimensions as the deck or a plurality of members having a length similar to the outer dimensions of the deck. In one embodiment, the deck has sockets in its upper surface for receiving upstanding pallet posts. The posts support side members and permit stacking of the pallets.

BRIEF DESCRIPTION OF THE DRAWINGS

The invention will now be described by way of example with reference to the accompanying drawings in which:

FIG. 1 is a shematic exploded perspective view of a basic deck and base means;

FIG. 2 is a perspective view of another base means;

FIG. 3 is a perspective view of still another base means;

FIGS. 4, 5 and 6 are perspective view of individually variable inserts which are fitable to said deck means;

FIG. 7 is a perspective view of a pallet post;

DETAILED DESCRIPTION OF THE DRAWINGS

Figure 9:
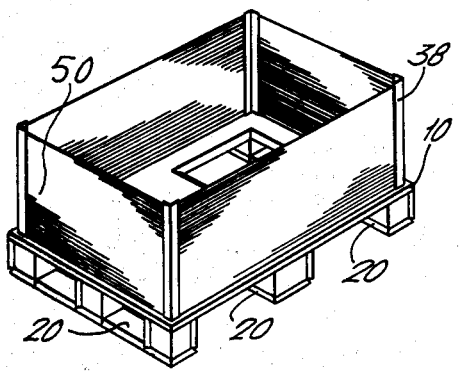
Figure 10:
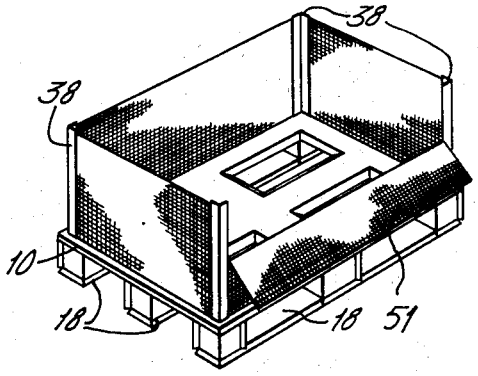

Referring to FIG. 1 of the drawings there is seen an exploded view of a rectangular deck generally indicated at 10 and fitted to base 12. Alternatively, the separate base sections 18 or 20 are fitted to deck 10. Bases 18 and 20, as shown in FIGS. 2 and 3, are generally equal in length to the long and short sides respectively of the deck 10. For example, as shown in FIG. 9 the deck 10 may have three of the short sections 20 fitted thereacross and as shown in FIG. 10 the deck 10 may have three long members 18 fitted therealong.

It is an important feature of the invention that a wide combination of pallet constructions is possible from a minimum number or interchangeable parts, and to that end the means for interconnecting the deck 10 and various base members 12, 18 and 20 are arranged to permit maximum flexibility. Thus, the deck and various base members each have connectors of similar construction and interchangeable arrangement.

Figure 11:
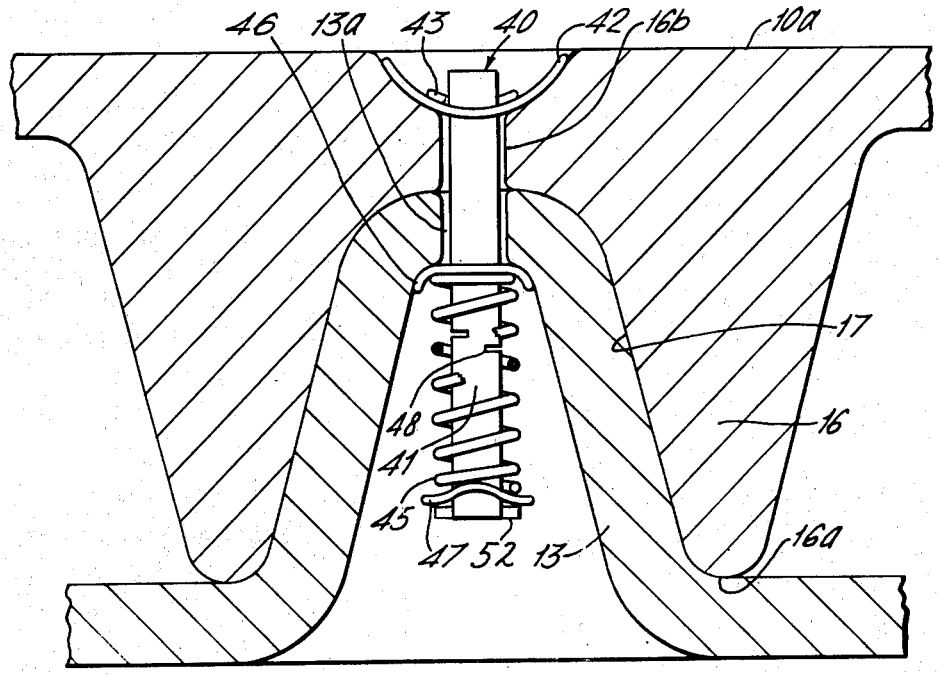
FIG. 11 is an elongated cross-sectional view of a means for attaching the deck and base means.

The deck 10 has a lower side from which a plurality of projections 16 extend downwardly and each projection has a conical recess 17 in a lower surface **16*a* as seen in FIG. 11. Each of the base members has mating interfitting projections 13, also illustrated in FIG. 11. The base member 12 of FIG. 1 is a rectangular memeber and includes upstanding conical projections 13 arranged and sized to be each received in the recesses 17. Similarly, the base section 18 and 20 as shown in FIGS. 2 and 3 have projections 13 spaced to mate with the spacings of the projection 16 along the length and width of the deck 10. As shown in FIGS. 9 and 10 three identical side sections of a configuration shown at 18 or 20 with their projections 13 are positioned to mate with rows of projections 16 on the deck means 10. The projections 16** are spaced about the deck as required. It is found that where two prong fork lift trucks are used three projections arranged in three rows along the length of the pallet and three rows across the width of the pallet are a well balanced, durable construction.

While the deck 10 is shown in combinations with the base 12 it will be understood that the deck may be used alone without the base in which it would be supported on the lower surfaces **16*a* of the projections 16**.

In practice, the outer, larger surfaces of the deck 10 and base means 12 are generally planar configuration although it is understood that other shapes are possible. Thus, the deck 10 includes a generally planar upper surface 10*a* and the base members 12, 18 and 20 include planar lower surfaces 12*a,* 18*a* and 20*a,* respectively.

The interfitting projections 16 and 13 function to align the deck and base to create structural strength. The deck means lower surfaces of any of the base sections 12*a,* 18*a* and 20*a* are generally parallel. The openings in the pallet sides between the deck and base created by the projections yield light weight and accommodate the prongs of a fork lift. A plurality of rectangular shaped holes or openings 14 are provided on upper side 10*a* of the deck and each opening is adapted to receive an insert of the types as shown for example in FIGS. 4, 5 and 6. Also, openings 14*d* are included in the base and are generally aligned to openings 14 in the deck.

Arrangements of the projections 16 about the perimeter of the deck means 10 and in the central area therebetween are adapted to the spacing of four openings 14 therein with each in a different quadrant. It will be understood that other projection arrangements between the deck and base means are adopted for other pallet shapes and other placements of the openings. Similarly, the particular shape and plan configuration of the projections are varied. With the rectangular configuration, a projection 16 generally centrally located on the deck means 10 extending from the lower surface 10*b* greatly increases the strength and load bearing capacity of the pallet. This increase in structural strength is especially beneficial when a projection 16 is coupled to a projection 13.

Figure 8:
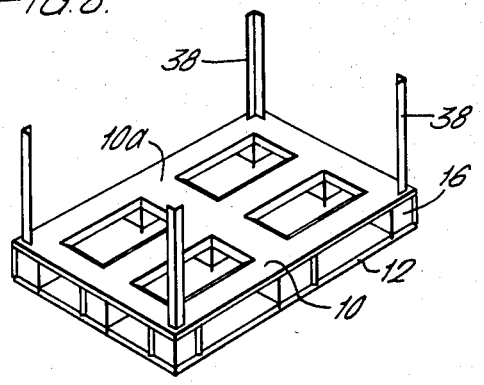
FIGS. 8, 9 and 10 are ech schematic perspective views of different combinations of pallet parts.

One or more sockets 30 are provided in a deck to receive a pallet post such as post 32 in FIG. 7. The pallet posts are of a right angular configuration and include an enlarged portion 34 to limit the length of post 32 which enters the socket 30 to that represented by a lower post portion 36. A recess (not shown) is provided around each socket 30 to receive the stop 34. The post 32 also includes an upper portion 38 extending above the pallet surface 10*a*. Advantageously, post portion 38 is perforated to allow a great number of functions including the attachment of fasteners. FIGS. 8, 9 and 10 illustrate other functions for the posts. In FIG. 8 the post portion 38 is perforated to allows attaching side support. As shown in FIG. 9, wire mesh section 50 is attached to the posts 32 to create a bin for handling loose articles. The base sections 12, 18 and 20 include suitable recesses (not shown) similar to slots 30 to receive the upper portions of the posts and thereby allow stacking or nesting of the pallets. In another variation shown in FIG. 10, a side portion 51 is hinged generally in the middle to allow access to a stacked bin type configuration when hinged side portion 51 is in a lowered position.

While posts 32 positioned in the corners as shown are very effective with rectangular pallets, other arrangements are possible such as having sockets 30 located near each projection. With standardized post parts easily attachable to the pallet, it is possible to fabricate custom pallet superstructures with inexpensive, easily stacked, and easily workable components.

Sockets in the lower surface of the base sections 12, 18 and 20 like sockets 30 adapted to receive a length of the upper portion 38 of a post 32 allow the pallets to be stacked.

Each of the openings 14 is left open or has an insert means positioned in the opening such as those shown in FIGS. 4, 5 and 6. The design of the inserts vary from industry to industry and are of various configurations such as the flush, open and raised examples 40, 42 and 44 respectively. Because of their relatively small size the inserts are relatively inexpensive to make and easy to inventory. It is expected that each industry will utilize a number of special inserts in addition to those common to many industries.

The openings 14 in the pallet deck preferably have a bevelled edge 14*a* therearound against which generally mating edges of the insert such as 40, 42 and 44 rest, whereas the edges are shown smooth they may have other configurations. Gravity or the weight of a load on the pallet hold the inserts in position. An additional attachment for the inserts is provided in various suitable forms where required.

Assembly of the pallet deck 10 and base units 12, 18 and 20 is effected by providing a spring loaded camlock type connector generally indicated at 40 through mating openings 16*b* and 13*a* in the deck and base projections respectively. Each of the connectors includes a shaft 41 having a washer 42 at the upper end retained by a suitable means such as pin 43, and coil spring 45 at the other end retained between washers 46 and 47. Washer 46 slides along shaft 41 and bears against base projection 13. Washer 47 is retained by a pin 52 through the shaft 41. The washer 42 is fit into a recession in deck surface 10*a*. The base and deck are clamped together between washers 42 and 46 under the force of spring 45. Shaft 41 includes weakened points 48 so that the shaft 41 acts as a shear pin to limit the amount of force on the connection. It has been found that with this type of connection the damage caused by inadvertant seperation of the deck and base during use is greatly reduced. Thus, for example, if the forward sheels of a fork lift should happen to engage the base and hold it down while the fork applies its lifting force to the deck, the spring would give until at last the shaft would shear at 48 and allow the base and deck to separate. Replacement of the shaft would cost in the order of cents whereas damage to the pallet without this connection would amount to many dollars. Another advantage is that the condition is noticeable when the spring gives way and before shear so that corrections are to be made without any damage occuring. The detachable connectors 40 also have the advantage that the pallet components are quickly rearranged to suit a changed condition.

In one embodiment, the pallet components are molded of a structural form thermoplastic material as for example polyethylene which preferably includes one percent carbon black to avoid ultra-violet light degradation. This material has a high strength to weight ratio and is quickly and inexpensively repaired by semi-skilled labor. Damaged moldings or obsolete pallets have a definite recycle value. Moreover, the plastic material is dimensionally stable, does not absorb mixture, is clean and is not attractive to pilferage.

While we have described and illustrated herein a preferred form of the invention, it is apparent to those skilled in the art that changes and modifications are possible without departing from the spirit and intent of the invention.

What is claimed is:

1. A multipurpose pallet comprising:

a. a deck member having a generally planar upper surface with a plurality of openings of substantially the same size therein, the openings being adapted to receive inserts, the lower surface of the deck member having projections defining sockets extending downwardly; and b. a base member having upwardly extending projections positioned and shaped to contact the projections extending downwardly in a mating fashion, the base member supporting the deck member so that the base member and the deck member are in substantially parallel planes, the deck member and base member being fastened together by shear pins passing through aligned holes in the upwardly and downwarly extending projections, spring means connected to one end of each of said shear pins and to one of said members with the other end of each of said shear pins connected to the other of said members thereby providing a yieldable break-away connection between the deck member and the base member all the downwardly extending projections being similarly shaped and all the upwardly extending projections being similarly shaped so that any upwardly extending projection and any downwardly extending projection can be brought together in a mating fashion.

2. The multipurpose pallet of claim 1 wherein there is a single base member having outer dimensions substantially the same as the corresponding outer dimensions of the deck member.

3. The multipurpose pallet of claim 1 wherein there are at least two individual base members which are arranged parallel to each other and each of which extends along substantially all of one dimension of the deck member.

4. The multipurpose pallet of claim 1 wherein at least one of the openings contains an insert.

5. The multipurpose pallet of claim 4 wherein the insert is a solid member which is in substantially the same plane as the deck surface.

6. The multipurpose pallet of claim 4 wherein the insert contains a pattern of small openings.

7. The multipurpose pallet of claim 4 wherein the insert is as shaped form.

8. The multipurpose pallet of claim 1 further including shaped upright pallet posts received in sockets around the periphery of the deck member, the sockets being matched to the shape of the pallet posts, the pallet posts extending above the deck member.

9. The multipurpose pallet of claim 8 wherein a mesh material extends between the pallet posts around at least three sides of the deck member to form a bin.

10. The multipurpose pallet of claim 8 wherein the base member includes shaped sockets positioned to receive pallet posts to allow the pallets to be stacked.

* * * * *